US009556007B2

(12) United States Patent
Karp et al.

(10) Patent No.: US 9,556,007 B2
(45) Date of Patent: Jan. 31, 2017

(54) SYSTEM FOR REARRANGING THE COUNTERWEIGHT OF A CRANE OPERATION

(75) Inventors: Guenter Karp, Wilmington, NC (US); Thorsten Helwes, Homburg (DE); Hans Schneider, Viby J (DK)

(73) Assignee: TEREX CRANES GERMANY GMBH, Zweibruecken (DE)

( * ) Notice: Subject to any disclaimer, the term of this patent is extended or adjusted under 35 U.S.C. 154(b) by 171 days.

(21) Appl. No.: 13/612,024

(22) Filed: Sep. 12, 2012

(65) Prior Publication Data

US 2014/0069883 A1 Mar. 13, 2014

(51) Int. Cl.

| | |
|---|---|
| ***B66C 23/53*** | (2006.01) |
| ***B66C 23/76*** | (2006.01) |
| ***B66C 23/52*** | (2006.01) |
| ***B66C 23/74*** | (2006.01) |

(52) U.S. Cl.

CPC ..... *B66C 23/52* (2013.01); *B66C 23/74* (2013.01)

(58) Field of Classification Search

CPC ..... B66C 23/52; B66C 23/53; B66C 23/74; B66C 23/76

USPC ..... 212/307, 308, 309, 196, 197, 256, 195

See application file for complete search history.

(56) References Cited

U.S. PATENT DOCUMENTS

| | | | | |
|---|---|---|---|---|
| 1,343,630 | A * | 6/1920 | Locarni | 212/277 |
| 2,374,074 | A * | 4/1945 | Berby | B66C 23/36 212/239 |
| 3,202,299 | A * | 8/1965 | Decuir | 212/195 |
| 3,438,516 | A * | 4/1969 | Bastide | 414/142.8 |
| 3,836,010 | A * | 9/1974 | Lampson | 212/195 |
| 3,842,984 | A * | 10/1974 | Brown et al. | 212/195 |
| 3,921,815 | A * | 11/1975 | Brown et al. | 212/195 |

(Continued)

FOREIGN PATENT DOCUMENTS

| | | |
|---|---|---|
| CN | 201427842 Y | 3/2010 |
| EP | 2189575 A1 | 5/2010 |

(Continued)

OTHER PUBLICATIONS

International Search Report for PCT/EP2013/068546 mailed Oct. 28, 2013.

(Continued)

*Primary Examiner* — Emmanuel M Marcelo
*Assistant Examiner* — Justin Stefanon
(74) *Attorney, Agent, or Firm* — Browdy and Neimark, PLLC

(57) ABSTRACT

A system (19; 19, 35) for reducing an amount of a counterweight for a crane comprises a crane (2) having a founding structure (3) being disposed on a base (20), a coupling unit (4), and a superstructure (5) being coupled to the founding structure (3) via the coupling unit (4). The system (19; 19, 35) further comprises a suspension device (21; 21, 36) for suspending the crane (2) at the base (20), said suspension device (21; 21, 36) having a guiding structure (22; 22, 37) defining a guiding direction (23; 23, 38), said guiding structure (22; 22, 37) being attached to the base (20), a displacement device (24) being displaceably attached to the guiding structure (22; 22, 37) along the guiding direction (23; 23, 38), and at least one suspension element (29) being connected with a first end to the crane (2) and being connected with a second end to the displacement device (24).

16 Claims, 7 Drawing Sheets

(56) References Cited

U.S. PATENT DOCUMENTS

| | | | | | |
|---|---|---|---|---|---|
| 3,930,583 | A * | 1/1976 | Jouffray | | 212/195 |
| 4,030,441 | A * | 6/1977 | Nagata et al. | | 114/242 |
| 4,042,115 | A * | 8/1977 | Beduhn et al. | | 212/178 |
| 4,067,446 | A * | 1/1978 | Ray | | 212/277 |
| 4,074,817 | A * | 2/1978 | Ray | | 414/138.5 |
| 4,074,818 | A * | 2/1978 | Ray | | 414/138.5 |
| 4,076,128 | A * | 2/1978 | Tax | | 212/195 |
| 4,170,309 | A * | 10/1979 | Lampson | | 212/198 |
| 4,187,949 | A * | 2/1980 | Komatsu | B66C 23/84 | 212/240 |
| 4,243,148 | A * | 1/1981 | Lampson | | 212/196 |
| 4,266,680 | A * | 5/1981 | Velikoselsky | B66C 23/52 | 212/167 |
| 4,280,627 | A * | 7/1981 | Becker | | 212/198 |
| 4,297,961 | A * | 11/1981 | Johnson, Jr. | B63B 35/44 | 114/123 |
| 4,316,548 | A * | 2/1982 | Helm et al. | | 212/196 |
| 4,358,021 | A * | 11/1982 | Helm et al. | | 212/195 |
| 4,361,104 | A * | 11/1982 | Lloyd et al. | | 114/258 |
| 4,449,635 | A * | 5/1984 | Helm et al. | | 212/196 |
| 4,540,097 | A * | 9/1985 | Wadsworth et al. | | 212/196 |
| 4,555,032 | A * | 11/1985 | Mick et al. | | 212/302 |
| 4,569,453 | A * | 2/1986 | Oustad | | 212/299 |
| 4,579,234 | A * | 4/1986 | Delago et al. | | 212/178 |
| 4,601,402 | A * | 7/1986 | Helm et al. | | 212/301 |
| 4,614,275 | A * | 9/1986 | Zenno | | 212/198 |
| 4,711,358 | A * | 12/1987 | Konishi | | 212/178 |
| 4,729,486 | A | 3/1988 | Petzold et al. | | |
| 4,787,524 | A * | 11/1988 | Cobb, III | B66D 1/58 | 212/262 |
| 5,005,714 | A * | 4/1991 | Kroll | B66C 23/36 | 212/178 |
| 5,035,337 | A * | 7/1991 | Juergens | | 212/196 |
| 5,580,189 | A | 12/1996 | Sanders et al. | | |
| 6,279,764 | B1 * | 8/2001 | Stoof | | 212/177 |
| 6,499,611 | B1 * | 12/2002 | Franzen et al. | | 212/196 |
| 6,508,372 | B1 * | 1/2003 | Lamphen | B66C 23/36 | 212/196 |
| 6,568,547 | B1 * | 5/2003 | Kretschmer et al. | | 212/196 |
| 6,588,521 | B1 * | 7/2003 | Porubcansky | B66C 23/36 | 180/9.1 |
| 6,808,337 | B1 * | 10/2004 | Thomsen | B63B 21/50 | 114/264 |
| 7,331,476 | B2 * | 2/2008 | Yerly | B66C 23/68 | 212/196 |
| 7,766,176 | B2 * | 8/2010 | Pech | | 212/196 |
| 8,016,519 | B2 * | 9/2011 | Bingham | B63B 27/10 | 405/204 |
| 8,376,158 | B2 * | 2/2013 | Kaneko | B66C 23/00 | 212/270 |
| 8,528,755 | B2 * | 9/2013 | Kurotsu | B66C 23/76 | 212/196 |
| 8,550,266 | B2 * | 10/2013 | Settlemier | B66C 23/08 | 212/195 |
| 8,960,461 | B2 * | 2/2015 | Kakeya | B66C 23/74 | 212/195 |
| 2005/0211651 | A1 | 9/2005 | Tyler | | |
| 2007/0084816 | A1 * | 4/2007 | Roodenburg et al. | | 212/270 |
| 2008/0295756 | A1 * | 12/2008 | van der Velde et al. | | 114/56.1 |
| 2009/0289495 | A1 * | 11/2009 | Zollondz | B62D 21/186 | 305/120 |
| 2011/0017695 | A1 * | 1/2011 | Vandenbulcke et al. | | 212/279 |

FOREIGN PATENT DOCUMENTS

| | | | |
|---|---|---|---|
| EP | 2383219 | A2 | 11/2011 |
| SU | 1765103 | A1 | 9/1992 |
| WO | 2007/030015 | A2 | 3/2007 |

OTHER PUBLICATIONS

Chinese Office Action for Chinese Patent Application No. 2013 8004 6492.1 dated Jun. 22, 2016.

* cited by examiner

SYSTEM FOR REARRANGING THE COUNTERWEIGHT OF A CRANE OPERATION

FIELD OF THE INVENTION

The invention relates to a system enabling a rearrangement of a counterweight assembly and configuration of such in a crane operation. Said system is in particular a system for reducing an amount of a counterweight for a crane, which needs to be cared for by the crane structure itself or by additional counterweight elements.

BACKGROUND OF THE INVENTION

U.S. Pat. No. 6,808,337 B1 discloses a maritime vessel with a stationary crane mounted thereon. The crane comprises a counterweight in order to counterbalance external and internal moments resulting from a load moment and to prevent tipping of the crane. A maritime vessel 1 according to the prior art is illustrated in FIG. 1, 2. A crane 2 is provided stationary on the vessel 1. The crane 2 comprises a founding structure 3 as a tower structure, a coupling unit 4 as a slewing ring and a superstructure 5 which is coupled to the founding structure 3 utilizing the coupling unit 4. The superstructure 5 comprises a base crane structure 6 which is directly connected via the coupling unit 4 to the founding structure 3. The superstructure 5 is slewably coupled to the founding structure 3 around a vertical axis 7. The superstructure 5, the coupling unit 4 and the founding structure 3 are coaxially aligned with the vertical axis 7. The superstructure 5 further comprises a main boom 8 and a derrick mast 9. The derrick mast 9 is also called superlift (SL) mast. The main boom 8 is pivotally hinged at a first end to the base crane structure 6. The derrick mast 9 is pivotally hinged at a first end to the base crane structure 6. The crane 2 enables lifting, holding and lowering a load 10 that is carried at a second end of the main boom 8. The main boom 8 is connected to the derrick mast 9 via a main stay 11. At a second end 12 of the derrick mast 9 a pendant 13 is provided for suspending a superlift counterweight 14. Further, the base crane structure 6 carries at least two superstructure counterweights 15 that are symmetrically aligned on both sides of the base crane structure 6. Further, the second end 12 of the derrick mast 9 is connected via pendants 16 to an A-frame 17 and to a boom hoist pulley 18.

U.S. Pat. No. 4,729,486 discloses a ring lift crane having a counterweight being radially displaceable connected to a base crane concerning a vertical slewing axis. In order to reduce an effective amount of the counterweight required for a safe operation of the crane, it is known from an article "Sarens goes to sea", dated Aug. 13, 2008 published in the magazine "Cranes today" to connect cables in order to detour the superlift counterweight forces away from the crane. Such connection cables are fixed to lugs welded onto the deck of a barge. US 2005/0211651 A1 discloses a stationary system for reducing the counterweight that needs to stay on a crane, whereby a derrick mast is connected via a connection cable directly to a stationary basement.

It is disadvantageous to the operation of a crane if it is either unflexible in its configuration thus its geometry due to tied down connection cables or if the overall crane structure itself becomes heavy due to the requirement to provide sufficient on board counterweight.

SUMMARY OF THE INVENTION

It is therefore an object of the invention to provide a system such that a crane provides both, flexibility during its different operational modes and reduction of at least one counterweight needed.

This object is achieved according to the invention by a system for rearranging the counterweight of a crane operation for reducing an amount of a counterweight for a crane. Said system comprising a crane, comprising a founding structure being disposed on a base, a coupling unit, a superstructure being coupled to the founding structure via the coupling unit, and the system further comprising at least one suspension device for suspending the crane at the base, said suspension device comprising a guiding structure defining a guiding direction, said guiding structure being attached to the base, a displacement device being displaceably attached to the guiding structure along the guiding direction, and at least one suspension element being connected with a first end to the crane and being connected with a second end to the displacement device.

According to the invention it was recognized that a suspension device enables three features at once, suspending the crane at the base, diminishing the amount of counterweight required at the crane structure and in particular as a superlift counterweight and enabling motion of the crane. The crane is suspended via the at least one suspension element at the base. The displacement device is attached to the guiding structure on the one hand and displaceably guided along the guiding direction on the other hand. In particular the crane is suspended in a direction perpendicular to the guiding direction. In particular, the guiding direction spans a guiding plane, wherein the suspension is provided perpendicular to the guiding plane. In particular, the crane is vertically suspended at the base, whereas the displacement device is displaceably guided along a horizontal guiding direction. The guiding structure is in particular stationarily attached to the base in a releasable manner. In particular, the guiding structure is fixed to a base plate that is releaseably connected to the base, e. g. by a beam construction holding the base plate at the base, wherein the beam construction is releaseably attached to the base. The crane is in particular stationary disposed above the base, which is in particular the ground or a deck or a hull of a vessel. That means that the founding structure is unmovable in respect to the base. However, a motion, in particular slewing or lateral, of the crane is provided by the coupling unit which movably couples the superstructure to the founding structure. In particular, the at least one suspension element is provided as a pendant. In particular, the system diminishes the requirement to maintain counterweight of a particular weight and of a particular size to a very small extent of at the most 30%, in particular at the most 20% and in particular at the most 10% of the initial amount of the counterweight. In particular, the system prevents the necessity of counterweight at all.

According to a preferred embodiment of the system, the at least one suspension element is connected with a first end to a superlift mast of the crane. Said system enables the reduction up to the avoidance of a superlift counterweight. In particular, the at least one suspension element is connected to a second end, which is the tip of the superlift mast. In typical superlift operation a superlift mast is provided with a counterweight suspended thereof in order to counterbalance a load moment and in order to prevent tipping of the crane and overload of the internal structures of the crane. The superlift mast is structured as a derrick mast.

According to a preferred embodiment of the invention, the at least one suspension element is directly connected with a first end to a base crane structure of the superstructure of the crane. A counterweight directly attached to the base crane structure thus can be fully replaced. Such counterweight is usually needed at the base crane structure in order to counterbalance the internal moment and to protect the base crane structure from creating an overload on one side under rigging conditions. Providing the connection of the base crane structure to the base, in particular of a vessel, the load moment of the base crane structure is lead directly into the base in particular and in the case where the base is part of a vessel, the load moment is lead directly into a structure of the vessel.

A system with the superstructure being slewably coupled to the founding structure around a slewing axis provides rotational motion of the superstructure in respect to the founding structure. In particular, the superstructure and the founding structure are coaxially aligned with the slewing axis. In particular, the slewing axis is perpendicular to the base and in particular vertically oriented. It is possible to provide a rotation of the superstructure regarding the founding structure while the crane is suspended.

According to another embodiment of the invention, the superstructure is displaceably coupled to the founding structure along a displacement direction. In particular, the overall displacement direction therefore can be along an inclination or runs straight. However, it is also possible to provide curved displacement direction of various geometry. Thus, it is possible to displace the superstructure in respect to the founding structure while the superstructure is suspended. In particular, the displacement direction is plane and in particular horizontally oriented. However, where the base is provided on a vessel, the base can be oriented transversally and therefore also the displacement direction is oriented transversally.

According to a further embodiment of the invention wherein the superstructure comprises a supporting frame, it is possible to take up forces which are at least partially oriented horizontally. Thus, it is possible to take up forces that result from friction between the displacement device and base while moving the displacement device along the guiding direction. In particular, the supporting frame has a planar structure. The supporting frame is of lightweight design. The frame comprises a high stability in the direction of the frictional forces, which are at least partially oriented horizontally.

According to a preferred embodiment the at least one suspension element is a chain. A chain provides easy handling, storage and repair. The space requirements and the technical requirements necessary for storing the chain are very little.

However, it is also possible to use ropes or rods instead of or in addition to a chain as the at least one suspension element. In particular, a rod may provide an enhanced stiffness regarding a chain thus enabling to keep the crane via the suspension in place or to block its movement in respect to the base under transport.

According to a preferred embodiment of the invention the guiding structure comprises a guiding track which is fixed to the base. In particular, the guiding track is provided with restraining means. Thus, it is possible to provide guided displacement of the displacement device along the guiding direction which defines a guiding plane. At the same time the displacement device is restrained in a direction perpendicular to the guiding plane. The guiding track may in particular be provided as a T-shaped guide rail.

According to a preferred embodiment, the displacement device comprises a bogie unit which simplifies the displacement along the guiding direction, which is in particular horizontally oriented.

According to a preferred embodiment the displacement device comprises a drive. In particular, if friction between the displacement device and the base occurs, the driven displacement device is enabled to overcome said friction forces. For that purpose, the drive is in particular provided as a continuous drive system, e. g. driven wheels on a track or a rack and pinion configuration. It is also possible to provide a discontinuously driven system like cylinders which could be hydraulic or pneumatic cylinders.

According to a preferred embodiment of the invention two suspension elements are provided and are arranged triangularly within a vertical plane. In particular, the two suspension elements are arranged as an inverted "V". Thus, it is simplified to provide tangential force from the suspension elements on each corresponding displacement device, which is necessary in order to overcome prevailing friction forces. Thus, it is not necessary to provide a deviation angle of an initially vertically arranged suspension element for applying a tangential force. In particular, each of the two suspension elements is connected with its second end to a corresponding displacement device and the two suspension elements are connected with their first ends to a common mounting device. In particular, the common mounting device is a gimbal mounting. The gimbal mounting can be connected at an intersection point of the triangularly arranged suspension elements. In particular, the intersection point is the vertex of the "V".

According to a preferred embodiment the common mounting device is connected firstly to the superstructure via the supporting frame, secondly to the superlift mast via a superlift mast suspension element, and thirdly to the displacement device via the two suspension elements.

According to a preferred embodiment of the invention, at least one load cell is provided for measuring a load acting on the at least one suspension element. In particular, the at least one suspension element is a superlift mast suspension element, a suspension element or a main boom suspension element. The at least one load cell can be integrated in the at least one suspension element itself. Further, it is possible to provide a control system that controls the measured loads. Thus, it is possible to prevent overload of the displacement device and of the at least one suspension element itself. It is also possible to provide a display device which is in signal connection with the at least one load cell or with the control system. It is possible to monitor the load acting on the at least one suspension element.

A further object of the invention is to configure a vessel in lieu of the base, thus providing a system for reducing an amount of a counterweight for a crane.

This object is achieved according to the invention by a vessel comprising a system for reducing an amount of a counterweight for a crane. Said system comprises a crane comprising a founding structure being disposed on a base, a coupling unit, and a superstructure being coupled to the founding structure via the coupling unit, and a suspension device for suspending the crane at the base, said suspension device comprising a guiding structure defining a guiding direction, said guiding structure being attached to the base, a displacement device being displaceably attached to the guiding structure along the guiding direction, and at least one suspension element being connected with a first end to the crane and being connected with a second end to the displacement device, wherein the base provided is located on a deck of the vessel. In particular, the base is provided on an upper deck of the vessel.

According to a preferred embodiment, the base for the suspension of the crane is provided inside a hull of the vessel between inner shells of the hull.

According to another preferred embodiment, the base for the suspension of the crane is provided inside the hull of the vessel on a mezzanine level between decks. In particular, the base is provided beneath the upper deck of the vessel.

According to a preferred embodiment, the base is provided inside the vessel such that the center of gravity of the vessel is in plane with the base. Thus, the vessel has an increased stability, in particular under crane operation, whilst the vessel is rolling, yawing and pitching.

In was recognized according to the invention that it is possible to provide a system for reducing an amount of a counterweight for the crane on a vessel and thus it is possible to provide an off-shore crane without the need of a crane mounted or crane suspended counterweight, whilst maintaining the flexibility during crane operation on the one hand and blocking the crane from slewing relatively to the vessel during transport on the other hand.

Embodiments of the invention will be described in more detail below with the add of the drawings.

DESCRIPTION OF THE PREFERRED EMBODIMENT

Figure 1:
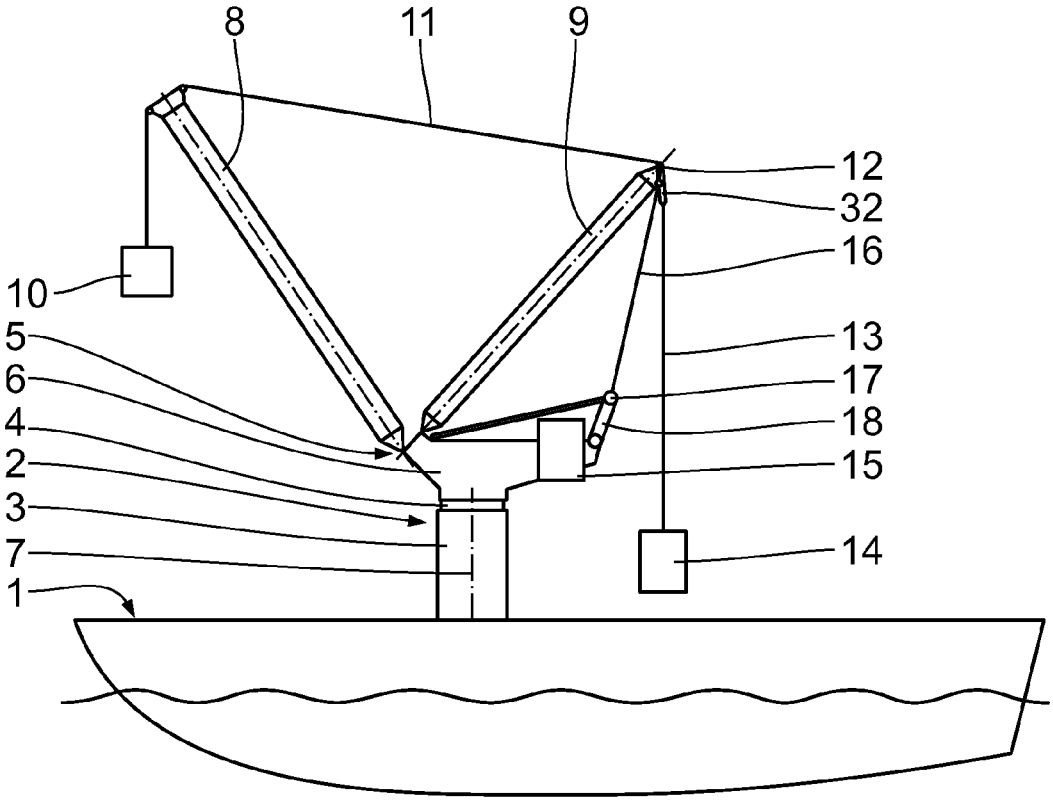
FIG. 1 shows a side view of a vessel with an onboard crane according to the prior art.
Figure 2:
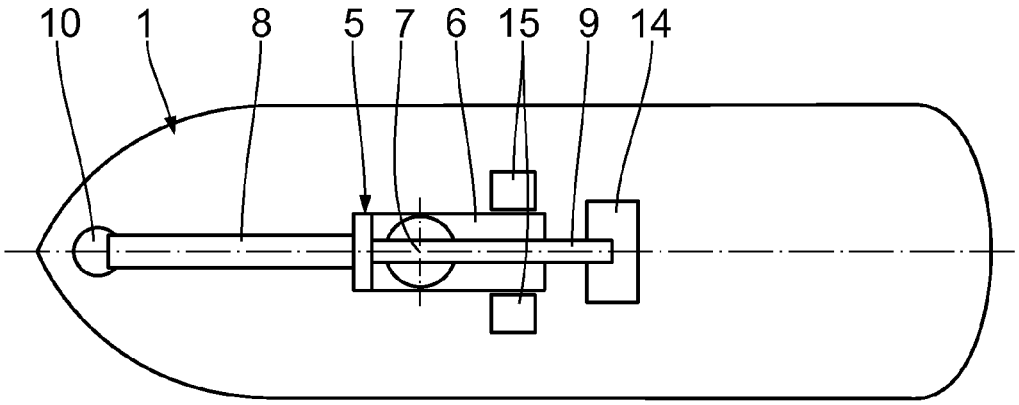
FIG. 2 shows a top view of the vessel in FIG. 1.
Figure 3:
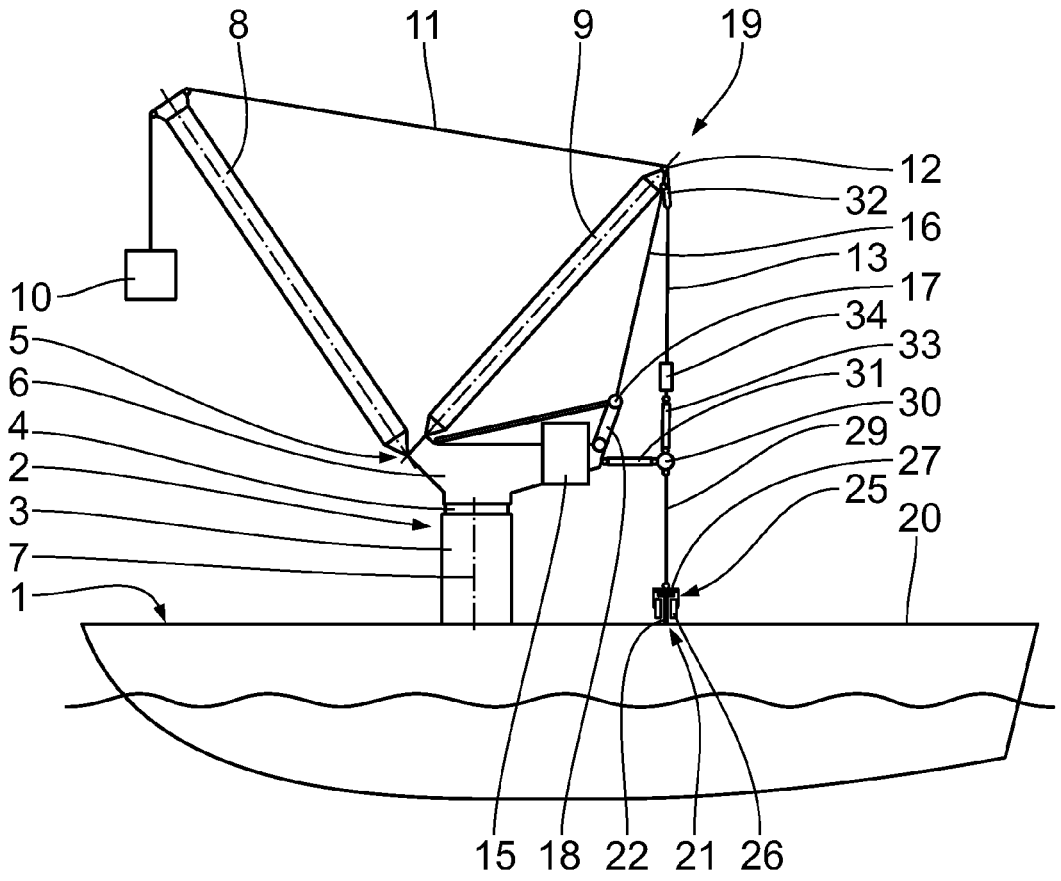
FIG. 3 shows a side view of a vessel with a system of a first embodiment.
Figure 4:
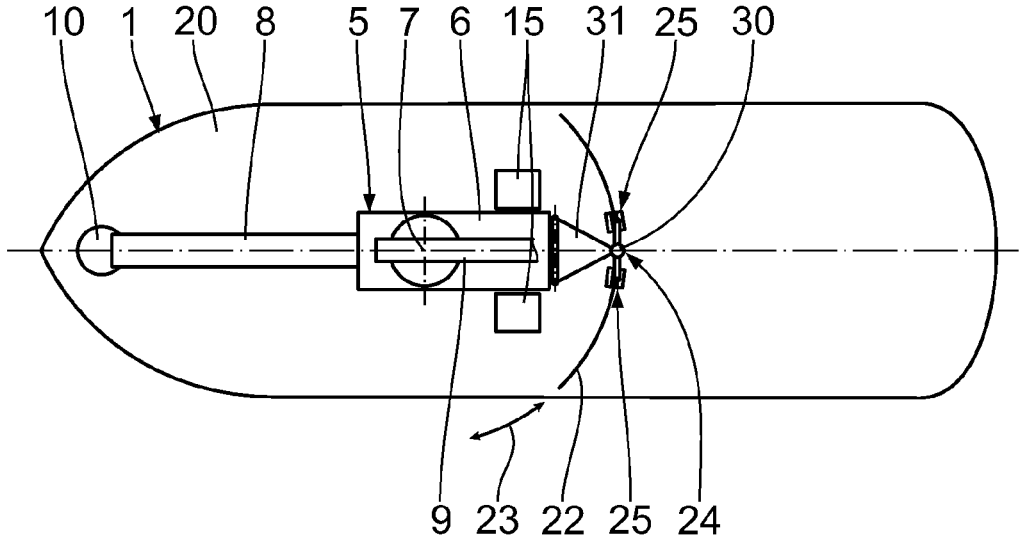
FIG. 4 shows a top view of the vessel in FIG. 3.
Figure 5:
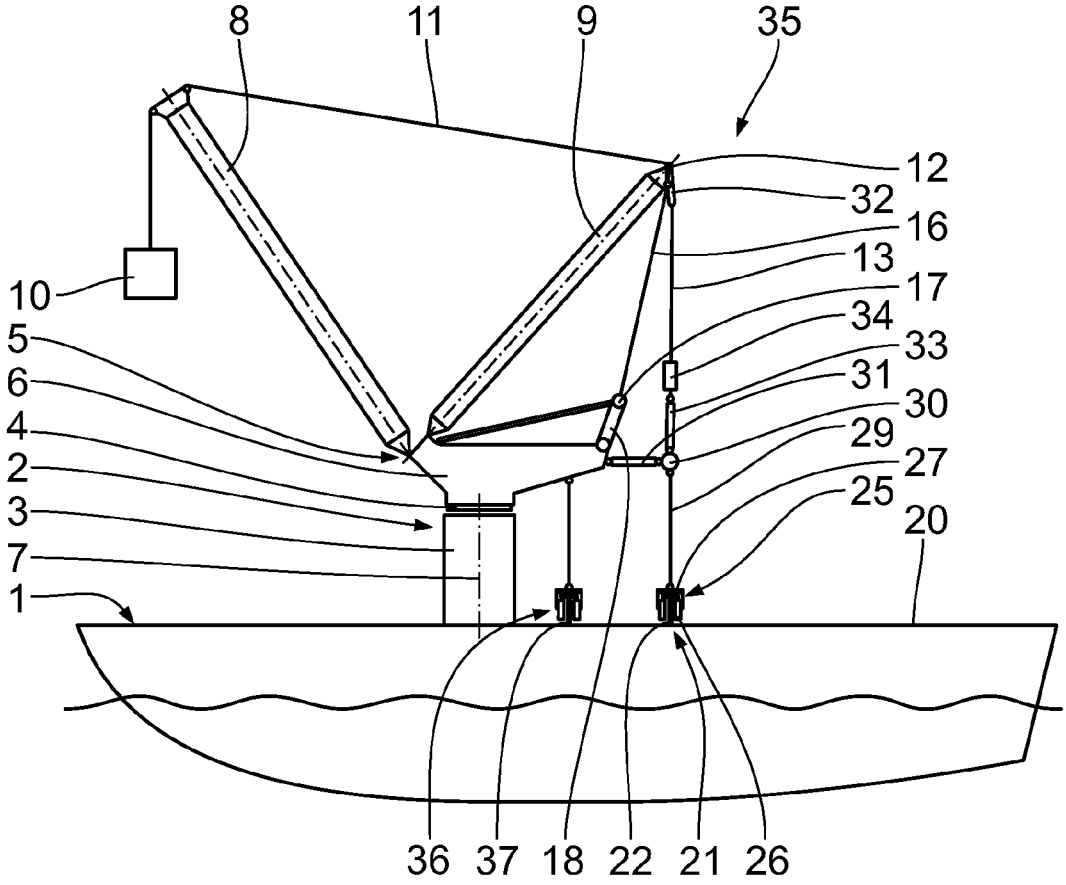
FIG. 5 shows a back view of the vessel in FIG. 3.

A vessel 1 according to FIGS. 3 to 5 comprises a system 19 according to the first embodiment of the invention. The system 19 enables the reduction of an amount of a counterweight of the crane 2. The founding structure 3 of the crane 2 is stationary disposed on a base 20. The base 20 is an upper deck of the vessel 1. The coupling unit 4 is a slewing ring and enables slewing of the superstructure 5 around the slewing axis 7 regarding the founding structure 3.

The base 20 is not part of the crane 2. In particular, it is also possible to provide the crane 2 on a stationary platform, e. g. of shore in the sea. It is further possible to provide the base on a barge or on a pontoon. It is also possible to provide the base 20 stationary on a flat roof of a large building.

The system 19 further comprises a suspension device 21 for suspending the crane 2 at the base 20. The suspension device 21 comprises a guiding structure 22 as a guiding track having a T-shaped guide rail. The guiding structure 22 defines a guiding direction 23. The guiding direction 23 is an arc of a circle, since the superstructure 5 is slewable around the slewing axis 7 regarding the founding structure 3. However, it is also possible to provide a coupling unit such that the superstructure 5 is displaceable along a track, in particular along a straight track. In that case, the guiding direction 23 is parallel to the track provided for the displacement of the superstructure. The arc of the circle is provided coaxially to the slewing axis 7. In particular, the slewing axis is oriented vertically.

The guiding structure 22 is stationary attached to the base 20. In particular, the guiding structure 22 is anchored in the base.

The system 19 further comprises a displacement device 24 comprising two bogie units 25. The bogie units 25 are arranged spaced apart along the guiding direction 23.

The guiding direction 23 is planar and defines a guiding plane which is parallel to the base 20.

The displacement device 24 is displaceably attached to the guiding structure 22 along the guiding direction 23. The displacement device 24 can be guided along the guiding direction 23 within the guiding plane. At the same time, the displacement device 24 is retrained by the guiding structure 22. In particular, the bogie unit 25 of the displacement device comprises a pair of rollers 26 that are connected with each other by a bracket 27. The bracket 27 at least partially encompasses the guiding structure 22. The rollers 26 are arranged parallel to the guiding direction 23. The guiding track of the guiding structure 22 is arranged between two corresponding rollers 26 in a direction perpendicular to the guiding direction 23. The rollers 26 are retained in a direction perpendicular to the guiding plane by the T-shaped guide rail of the guiding track. An enlarged view on the displacement device 24 is provided in FIGS. 10 and 11.

The displacement device 24 further comprises a at least one drive 28. In particular, the displacement device 24 comprises one drive for each of the rollers 26. In particular, a pair of rollers, i. e. two rollers 26, are provided on each sides of the guiding track. The suspension device is also called a track and roller device. That means, four rollers 26 are provided for each bogie unit 25. The displacement device 24 is connected via two suspension elements 29 each in form of a bogie pendant with a gimbal mounting as a common mounting device 30. The common mounting device 30 is attached to the superstructure 5, in particular to the upper carriage 6, via a supporting frame 31. The supporting frame 31 takes up forces being at least partially oriented horizontally. In particular, the forces that are taken by the supporting frame 31 result from friction that occurs between the displacement device 24 and the base 20. Thus, the friction forces are oriented along the guiding direction 23, i. e. in the guiding plane.

The system 19 further comprises a top mast spreader 32 and a bottom mast spreader 33. Between the top mast spreader 32 and the bottom mast spreader 33, the superlift counterweight pendants 13 are arranged in parallel. Further, a load cell 34 is attached to each of the superlift counterweight pendants 13.

The system 19 enables suspension of the crane 2 at the base 20, wherein the derrick mast 9 is suspended via the superlift counterweight pendants 13, the common mounting device 30 and the suspension elements 29 at the suspension device 21, i. e. via the displacement device 24 at the guiding structure 22.

As best seen in FIG. 5, the suspension elements 29 are arranged triangularly within a vertical plane. In particular, the suspension elements 29 are arranged as an inverted "V", wherein a vertex of the "V" is connected to the common mounting device 30. The common mounting device 30 is a single point joint that is attached at a rear end of the supporting frame 31. Thus, it is possible to provide the superlift counterweight pendants 13 parallel to each other from the common mounting device 30 via the bottom mast spreader 33 and the topmast spreader 32 to the tip 12 of the derrick mast 9 on the one hand. On the other hand it is possible to provide the suspension elements 29 triangularly between the superstructure 5 and the bogie units 25 of the displacement device 24. Thus, only lateral load in a mid-centre plane of supporting frame 31 is transferred via the gimbal mounting of the common mounting device 30. It is also possible to provide an additional winch on the supporting frame 31 in order to bring the suspension element 29 up/down to/from the joint of the supporting frame 31.

The common mounting device 30 is connected to the superstructure 5 via the supporting frame 31, to the superlift mast 9 via the superlift counterweight pendant 13 and to the displacement device 24 via the suspension element 29.

However, it is possible to provide the system 19 not only on the vessel 1 but also on a barge, pontoon or any other sea vehicle in order to replace or reduce the amount of a counterweight. In particular, it is also possible to provide the system 19 on the ground, wherein the crane 2 is fixed with the founding structure 3 on the ground. In particular, the superlift-counterweight which is necessary at a crane according to the prior art is prevented with the inventive system 19. However, the superstructure counterweight 15 is still provided.

The system 19 provides slewing or translation of the crane 2 with the derrick mast 9 concerning the founding structure 3. The system 19 comprises two bogie units 29 that run on a curved or a straight guiding track of the guiding structure 22. The guiding structure 22 is included in the base 20 of a carrier, i. e. the vessel 1. The bogie units 25 each are rolling on the track. The bogie units 25 follow the motion of the superstructure 5 of the crane 2, i. e. slewing around the slewing axis 7 or displacement along a straight or a curved track. A displacement of the bogie units 25 of the displacement device 24 is initiated as soon as a tangential force of a connection between the superstructure 5 and the bogie units 25 is large enough to overcome friction forces between the bogie units 25 and the guiding track of the guiding structure 22. Since the suspension elements 29 are triangularly arranged to each other, when slewing the superstructure tangential forces are provided on both of the suspension elements 29, wherein the tangential forces are high enough to centre the bogie units 25 under the superstructure 5. Thus, a non-continuous stick/roll movement of the bogie units 25 is prevented. Such stick/roll movement of the bogies units 25 may occur when using parallel arrangement of the suspension elements from the superstructure 5 to the bogie units 25. Then the superstructure 5 needs some tangential distance to the bogie units 25 in order to achieve an angle between the parallel line of the suspension elements 29 and a vertical axis. This will course tangential forces to move the bogies units 25. Since the static friction is higher than the rolling friction, the bogie units 25 are accelerated and thus will overtake the superstructure 5. When the superstructure 5 is still slewing, same procedure starts again and will thus lead to said non-continuous stick/roll movement of the bogie units 25.

In addition, the triangle-arrangement of the suspension elements 29 has its vertex at an upper centre point, which is located in between the bogies units 25. The suspension elements 29 provide an isosceles triangle.

Figure 6:
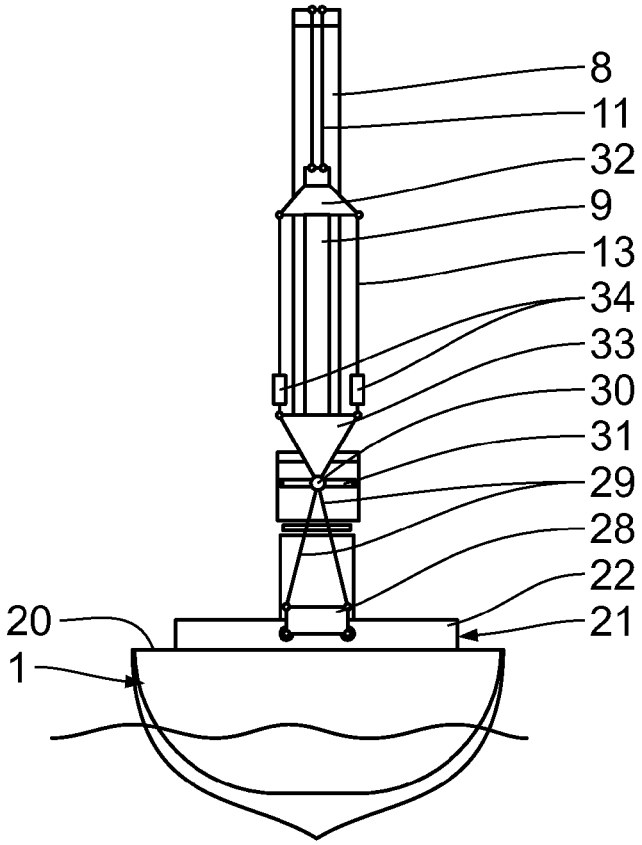
FIG. 6 shows a side view of a vessel with a system according to a second embodiment.
Figure 7:
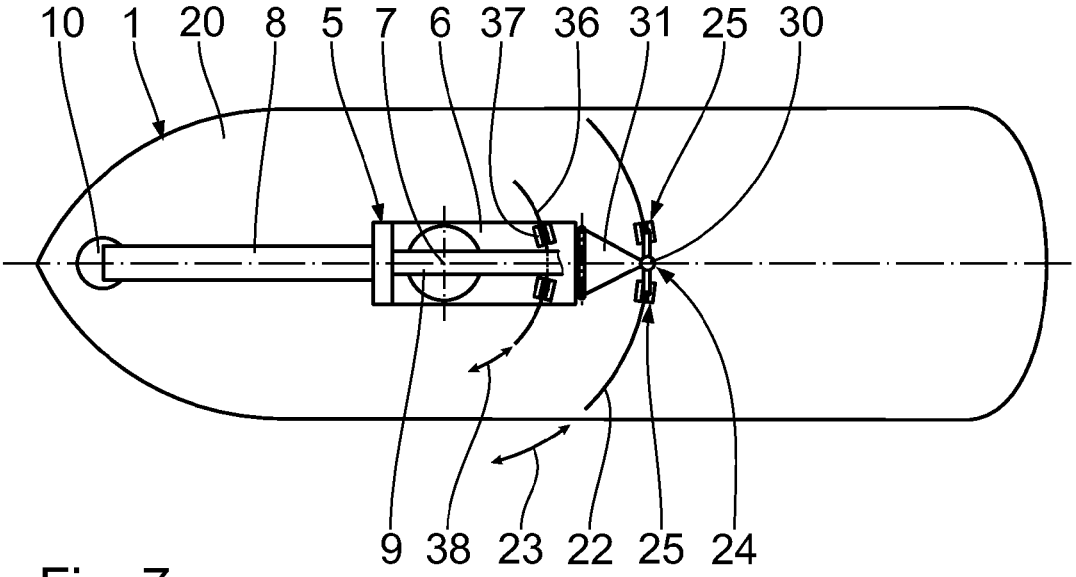
FIG. 7 shows a top view of the vessel in FIG. 6.

A further embodiment of a system according to the invention is illustrated in FIGS. 6 and 7. Components that correspond to those as described in previous FIGS. 1 to 5 have identical reference signs.

The system 35 differs from system 19 in that in addition to the first suspension device 21 a second suspension device 36 is provided. The second suspension device 36 is essentially identical to the first suspension device 21. In particular, the second suspension device 36 enables a suspension of the crane 2 at the base 20. The suspension device 36 comprises a second guiding structure 37 defining a second guiding direction 38. Both guiding structures 22, 37 are provided as an arc of a circle, wherein both guiding structures 22, 37 are arranged coaxially to the slewing axis 7

The displacement devices 24 that are displaceably attached to the guiding structures 22, 37 are identical. Also the suspension elements 29 are identical for the first and the second suspension device 21, 36.

The main difference is the arrangement of the suspension elements 29. The suspension elements 29 of the first suspension device 21 are connected to the derrick mast 9 as already explained above in order to compensate a superlift counterweight. The suspension elements 29 of the second suspension device 36 are directly connected to the upper carriage 6 of the superstructure 5 of the crane 2. Thus, the second suspension device 36 enables counterbalancing the superstructure counterweight, in particular to counterbalance internal loads. Thus, no counterweight is necessary anymore. The vessel 1 with the system 35 is free of any counterweight.

Figure 8:
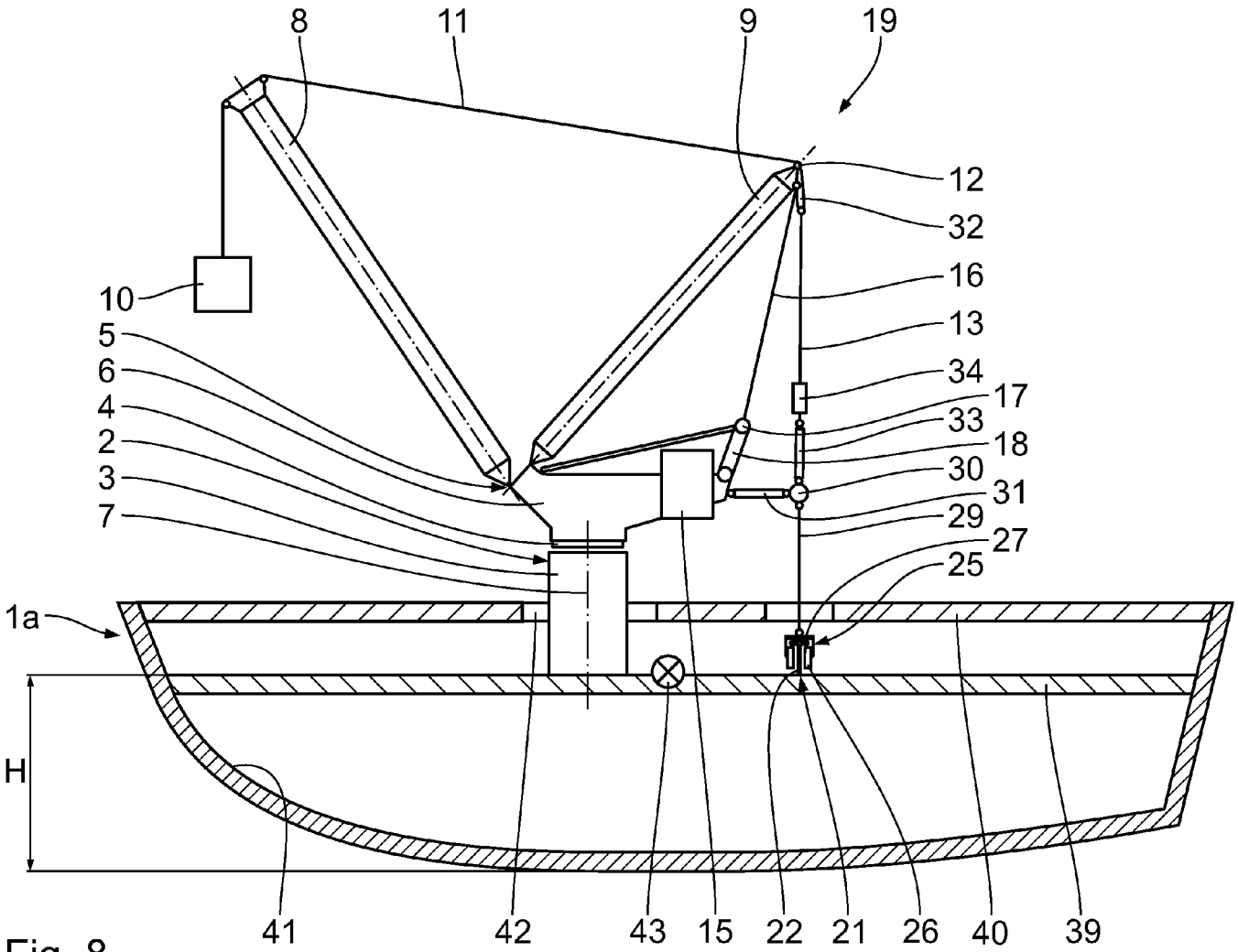
FIG. 8 shows a side view of a vessel with a system according to a third embodiment.
Figure 9:
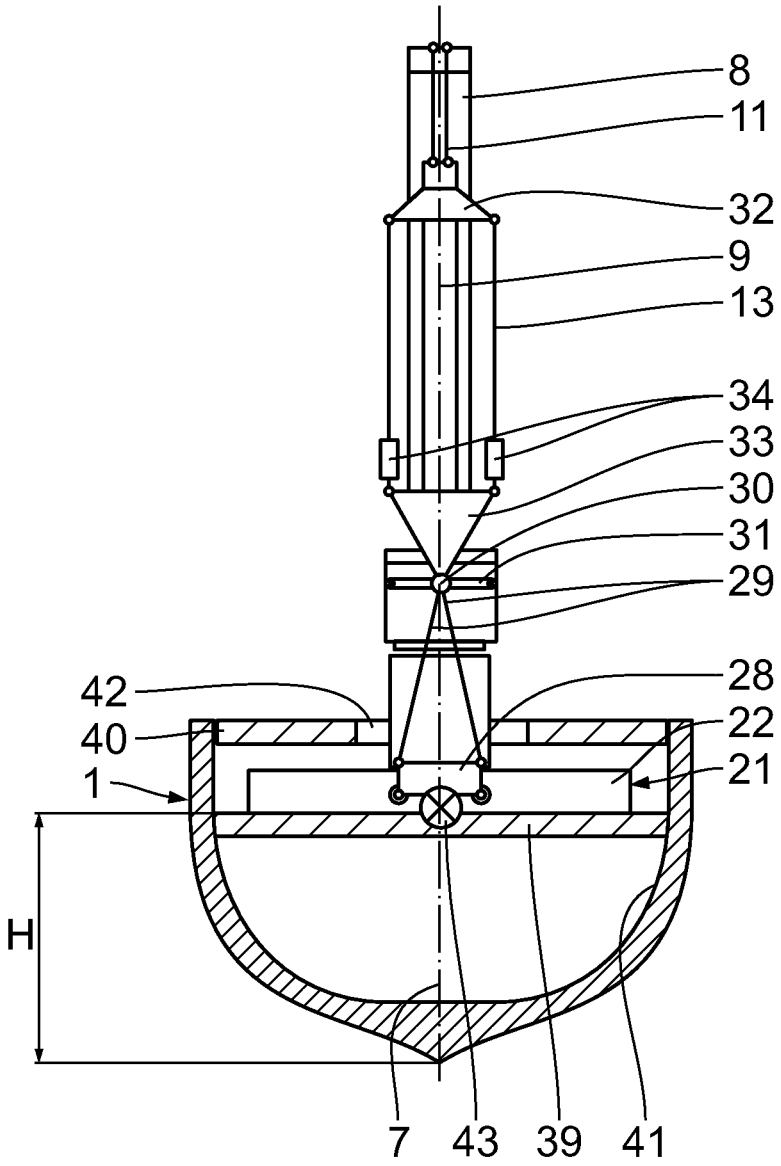
FIG. 9 shows a back view of the vessel in FIG. 8.

A further embodiment of a system according to the invention is illustrated in FIGS. 8 and 9. Components that correspond to those as described in previous FIGS. 1 to 7 have identical reference signs.

Similar to the first embodiment in FIGS. 3 to 5, the crane 2 comprises a superlift counterweight 15. The main difference concerning the crane in FIGS. 3 to 5 is that the founding structure 3 is provided on a base 39 which is on a mezzanine level under the upper deck 40 of the vessel 1. The base 39 is part of a hull of the vessel 1 and is directly attached to inner shells 41 of the vessel 1. In particular, the inner shells 41 enable deformation, i. e. absorb deformation during suspension.

The upper deck 40 has an opening 42 for guiding out the founding structure 3 of the inside of the vessel 1.

The height H of the base 39, i. e. the vertical distance of the base 39 to a lower end of the vessel 1, is provided such that the center of gravity 43 of the vessel 1 is in plane with the base 39. In particular, it is also possible to modify a lateral position of the crane 2 such that the center of gravity 43 is on the slewing axis 7.

Figure 10:
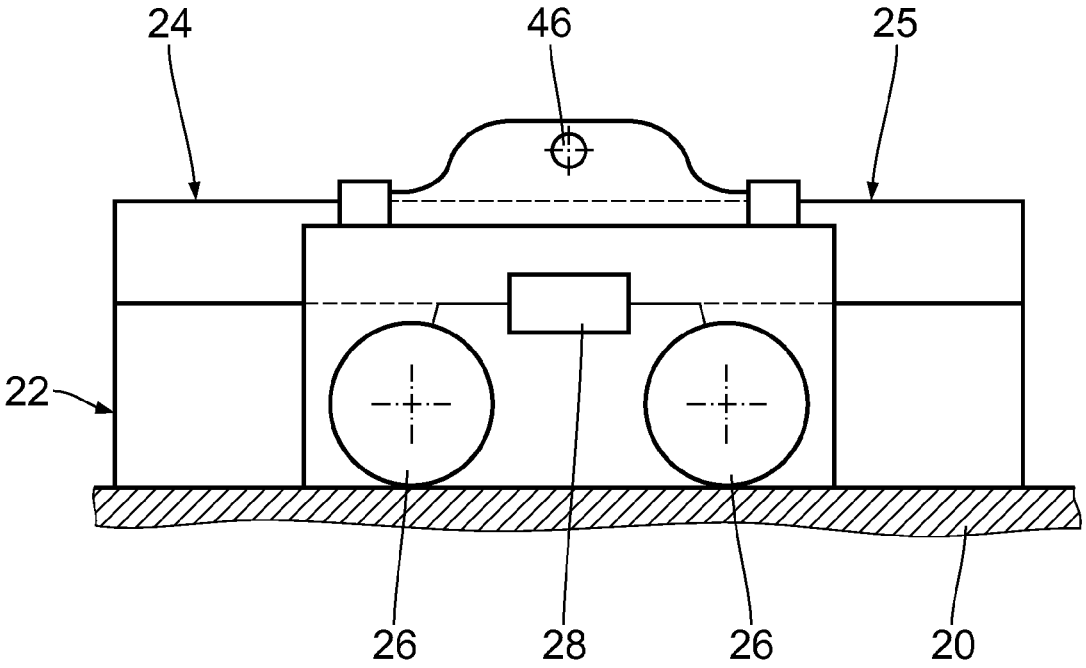
FIG. 10 shows an enlarged back view of a displacement device.
Figure 11:
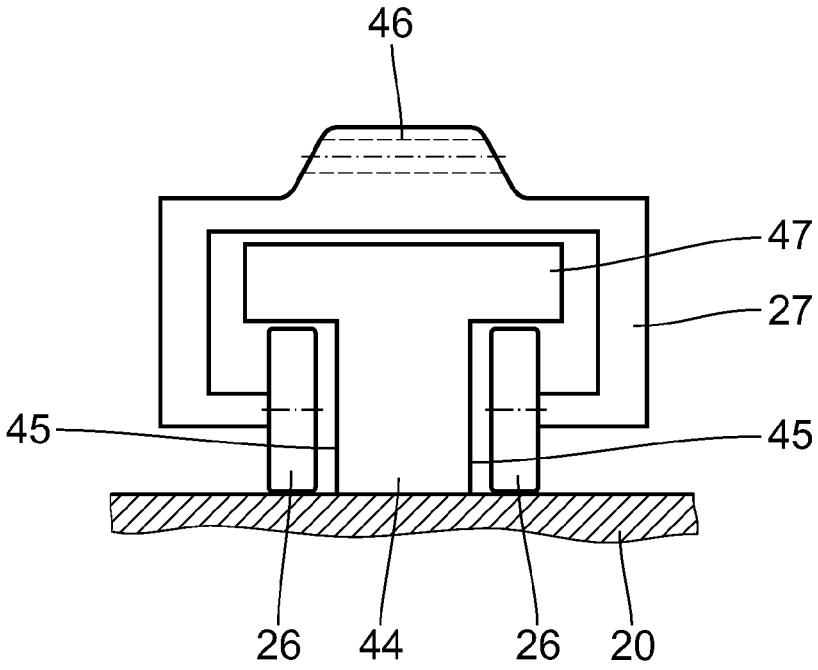
FIG. 11 shows a side view of the displacement device in FIG. 10.

FIGS. 10 and 11 each show an enlarged view of the displacement device 24, in particular one of the bogie units 25 of the displacement device 24.

The guiding structure 22 comprises the T-shaped guide rail 44. Two rollers 26 are provided on each side of vertical walls 45 of the guide rail 44. The rollers 26 are connected to a common drive 28. It is also possible to provide one drive for each of the rollers 26. The pair of rollers on each side of the T are connected with each other via a bracket structure 27. The bracket structure 27 encompasses an upper, horizontally oriented section 47 of the T. The rollers 26 roll on the base 20 during a motion of the crane and thus a motion of the displacement device 24. The rollers 26 are vertically secured by the section 47. The guide rail 44 enables horizontal guidance and prevents vertical movement.

In an upper, horizontal portion of the bracket structure 27 an connection opening 46 is provided. The connection opening 46 provides the connection of the bogie unit 25 with a pendant. In particular, the connection opening 46 enables hinge-connection with the pendant.

What is claimed is:

1. A system for rearranging the counterweight of a crane operation, said system comprising a crane (2) comprising a founding structure (3) being disposed on a base (20), said founding structure (3) being unmovable with respect to the base (20), a coupling unit (4), and a superstructure (5) being coupled to the founding structure (3) via the coupling unit (4), and at least one suspension device (21; 21, 36) comprising a guiding structure (22; 22, 37) defining a guiding direction (23; 23, 38), said guiding structure (22; 22, 37) being directly attached to the base (20), a displacement device (24) being displaceably directly attached with respect to the guiding structure (22; 22, 37) along the guiding direction (23; 23, 38), and at least one suspension element (29) being connected with a first end to the crane (2) and being directly connected with a second end to the displacement device (24), wherein the at least one suspension device (21; 21, 36) is anchored at the base (20) in the vertical direction to suspend the crane (2), wherein the at least one suspension element (29) is directly connected with the first end to a base crane structure (6) of the superstructure (5) of the crane (2), and wherein the superstructure (5) is slewably coupled to the founding structure (3) around a slewing axis (7).

2. The system according to claim 1, wherein the at least one suspension element (29) is connected with the first end to a superlift mast (9) of the crane (2).

3. The system according to claim 1, wherein the superstructure (5) is displaceably coupled to the founding structure (3) along a displacement direction.

4. The system according to claim 1, wherein the superstructure (5) comprises a supporting frame (31) which takes forces being at least partially oriented horizontally.

5. The system according to claim 1, wherein the at least one suspension element (29) is a chain.

6. The system according to claim 1, wherein the guiding structure (22; 22, 37) comprises a guiding track being fixed to the base (20).

7. The system according to claim 1, wherein the displacement device (24) comprises a bogie unit (25) having at least two rollers.

8. The system according to claim 1, wherein the displacement device (24) comprises a drive (28).

9. The system according to claim 1, wherein at least one load cell (34) is provided for measuring a load acting on the at least one suspension element (29).

10. A vessel comprising a system (19; 35) according to claim 1, wherein the base (20) is provided on a deck of the vessel (1).

11. A system for rearranging the counterweight of a crane operation, said system comprising a crane (2) comprising a founding structure (3) being disposed on a base (20), said founding structure (3) being unmovable with respect to the base (20), a coupling unit (4), and a superstructure (5) being coupled to the founding structure (3) via the coupling unit (4), and at least one suspension device (21; 21, 36) comprising a guiding structure (22; 22, 37) defining a guiding direction (23; 23, 38), said guiding structure (22; 22, 37) being directly attached to the base (20), a displacement device (24) being displaceably directly attached with respect to the guiding structure (22; 22, 37) along the guiding direction (23; 23, 38), and at least one suspension element (29) being connected with a first end to the crane (2) and being directly connected with a second end to the displacement device (24), wherein the at least one suspension device (21; 21, 36) is anchored at the base (20) in the vertical direction to suspend the crane (2), wherein two suspension elements (29) are provided at one suspension device (21; 21, 36), said two suspension elements (29) are arranged triangularly within a vertical plane and the second end of each of the two suspension elements being connected to one another, and wherein the superstructure (5) is slewably coupled to the founding structure (3) around a slewing axis (7).

12. The system according to claim 11, wherein each of the two suspension elements (29) is connected with its second end to a corresponding displacement device (24) and wherein the two suspension elements (29) are connected with their first ends together at a common mounting device (30).

13. The system according to claim 12, wherein the at least one suspension element (29) is connected with the first end to a superlift mast (9) of the crane (2), wherein the superstructure (5) comprises a supporting frame (31) which takes forces being at least partially oriented horizontally, and wherein the mounting device (30) is connected to the superstructure (5) via the supporting frame (31)

to the superlift mast (9) via a superlift counterweight pendant (13), and to the displacement device (24) via the two suspension elements (29).

14. A system for rearranging the counterweight of a crane operation, said system comprising a crane (2) comprising a founding structure (3) being disposed on a base (20), said founding structure (3) being unmovable with respect to the base (20), a coupling unit (4), and a superstructure (5) being coupled to the founding structure (3) via the coupling unit (4), and at least one suspension device (21; 21, 36) comprising a guiding structure (22; 22, 37) defining a guiding direction (23; 23, 38), said guiding structure (22; 22, 37) being directly attached to the base (20), a displacement device (24) being displaceably directly attached with respect to the guiding structure (22; 22, 37) along the guiding direction (23; 23, 38), and at least one suspension element (29) being connected with a first end to the crane (2) and being directly connected with a second end to the displacement device (24), wherein the at least one suspension device (21; 21, 36) is anchored at the base (20) in the vertical direction to suspend the crane (2), wherein the base (39) is provided inside a hull of a vessel (1) between inner shells (41) of the hull, and wherein the superstructure (5) is slewably coupled to the founding structure (3) around a slewing axis (7).

15. The system according to claim 14, wherein the base (39) is provided on a mezzanine level beneath an upper deck (40).

16. The system according to claim 14, wherein the base (39) is provided at a height (H) in respect to a lower end of the vessel (1) such that the center of gravity (43) of the vessel is located in a plane of the base (39).

* * * * *